United States Patent [19]

Nakahara et al.

[11] Patent Number: 4,497,167

[45] Date of Patent: Feb. 5, 1985

[54] METHOD FOR PRODUCING SPUN YARNS

[75] Inventors: Teiji Nakahara, Kyoto; Toshifumi Morihashi, Shiga, both of Japan

[73] Assignee: Murata Kikai Kabushiki Kaisha, Kyoto, Japan

[21] Appl. No.: 463,277

[22] Filed: Feb. 2, 1983

[30] Foreign Application Priority Data

Feb. 3, 1982 [JP] Japan ..... 57-16662
Feb. 8, 1982 [JP] Japan ..... 57-19260

[51] Int. Cl.[3] ..... D01H 5/28; D01H 7/92
[52] U.S. Cl. ..... 57/328; 57/333
[58] Field of Search ..... 57/328, 331, 333, 315

[56] References Cited

U.S. PATENT DOCUMENTS 2,853,847 9/1958 Keeler et al. ..... 57/328
3,822,543 7/1974 Edagawa et al. ..... 57/328 X
4,112,658 9/1978 Morihashi ..... 57/333 X
4,142,354 3/1979 Nakahara ..... 57/328
4,183,202 1/1980 Morihashi ..... 57/328
4,387,487 6/1983 Nakahara et al. ..... 57/328 X

FOREIGN PATENT DOCUMENTS 6929 1/1979 Japan ..... 57/328

*Primary Examiner*—Donald Watkins
*Attorney, Agent, or Firm*—Spensley, Horn, Jubas & Lubitz

[57] ABSTRACT

A spun yarn is manufactured from a sliver through an action of a first fluid swirling nozzle and a second fluid swirling nozzle capable of swirling a fluid in a direction opposite to the direction of swirling of a fluid in the first fluid swirling nozzle. Fibers detached from a sliver between a front roller assembly and a first fluid swirling nozzle are caused to wind positively around the twisted fibers during spinning operation.

5 Claims, 13 Drawing Figures

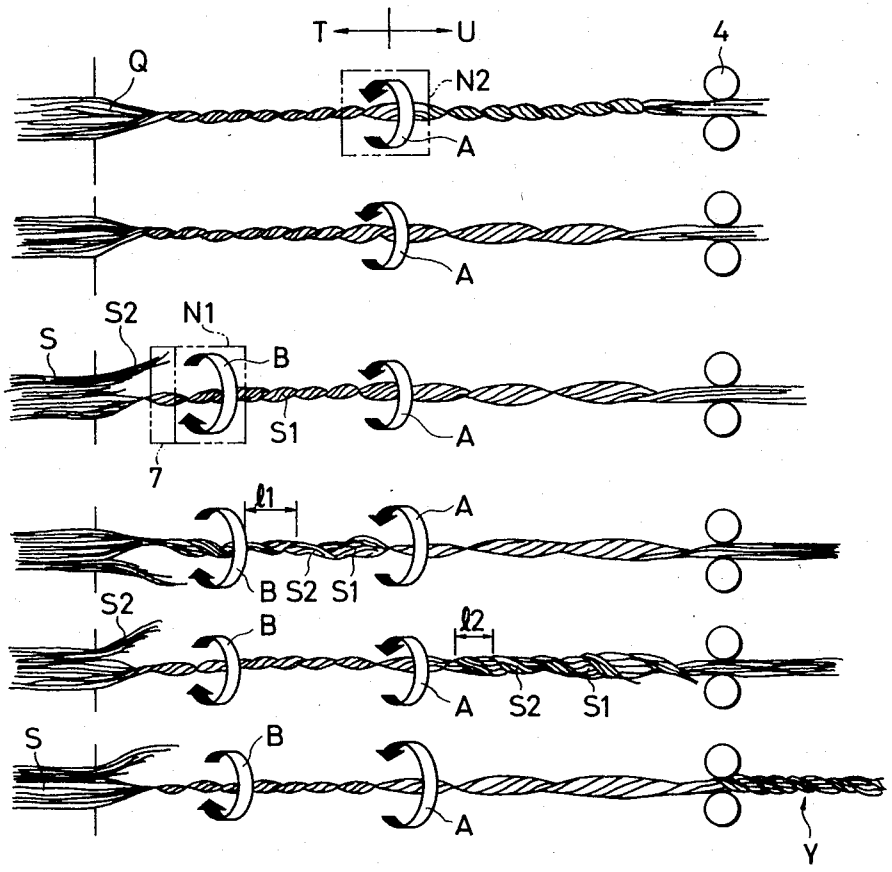
FIG. 6-a
FIG. 6-b
FIG. 6-c
FIG. 6-d
FIG. 6-e
FIG. 6-f

METHOD FOR PRODUCING SPUN YARNS

BACKGROUND OF THE INVENTION

The present invention relates to a spun yarn manufacturing method. Ring spinning method has been the principal spinning method throughout the history of spinning method since ring spinning method was developed. Recently, innovative spinning methods, such as open-end spinning method, false-twist spinning method and bundling spinning method, have been developed to achieve remarkable increase in spinning speed as compared with ring spinning method.

In a yard produced through ring spinning method, most component fibers are arranged in parallel and are turned generally in one direction to form a structure of a yarn commonly called as a single yarn having actual twists. In spinning a yarn according to ring spinning method, the yarn forms a balloon of a certain size due to the high-speed revolution of the traveler and the component fibers are twisted with the respective opposite ends thereof being caused to project over the surface of the yarn by a centrifugal force of a magnitude corresponding to the revolving rate and the diameter of the balloon, so that fluff is formed over the surface of the yarn and the fluff is increased by the rubbing action of the traveler on the yarn.

A rotor open-end spinning method is a representative open-end spinning method. However, according to the rotor open-end spinning method, since the component fibers are twisted while they are deposited practically in parallel arrangement over the inner circumferential wall of a rotating rotor, that is, the component fibers are twisted while they are scattered over the preceeding component fibers, the core fibers are highly twisted, whereas the outside component fibers are low twisted and are not twisted firmly around the core fibers. Consequently, the rotor open-end spinning method is incapable of producing such a yarn as a ring-twisted yarn in which all the component fibers are twisted integrally in a parallel arrangement. Accordingly, the fibers scattered in the last stage of rotor-twisting become so called bridge fibers or lap fibers which wind merely round the yarn, are not arranged along the direction of the twist of the yarn and twine themselves round the yarn degrading the appearance of the yarn and causing the reduction of the yarn strength and the production of fluff.

False twist spinning methods or bundling spinning methods are disclosed in Unexamined Patent Publication No. 56-79728, Examined Patent Publication No. 52-43256 and Examined Patent Publication No. 52-43257. According to those methods, the main part of a yarn is formed of 80 to 90% of the component fibers in a parallel fiber bundle and a small number of fibers are wound round the main part to bind the parallel fiber bundle so that a yarn strength is provided. The strength of such a yarn, setting a long staple yarn aside, particularly as short staple yarn formed by merely winding staple fibers round a practically zero-twisted parallel fiber bundle is low and since staple fibers are wound round the parallel fiber bundle with the respective opposite ends thereof being unrestrained, fluff is formed over the surface of the yarn.

According to a spinning method disclosed in Examined Patent Publication No. 55-4857, a passive or positive mechanical force, such as a frictional force, produced by vibration or ballooning is applied to a twisted fiber bundle twisted in a false-twisting zone to draw out fibers included in the fiber bundle in parallel to the yarn axis and those drawn-out parallel fibers are caused finally to wind round the fiber bundle in an untwisting zone after the twisting point of a false-twisting machine and thereby a bundled spun yarn is formed.

In either method, fibers arranged parallel in the twisting zone before the twisting point are used for finally binding the yarn, therefore, those bundling fibers are incapable of providing a high binding force.

That is, according to a bundling spinning method, the yarn structure is defined by making the minor part of the component fibers wind round a parallel fiber bundle consisting of the major part of the component fibers, therefore, the yarn comprises two parts, namely, a major fiber group forming the core part of the yarn and a minor fiber group winding round the yarn. Accordingly, such spinning methods have a disadvantage that although a satisfactory yarn strength is provided for the yarn when the yarn consists of relatively long fibers, sufficient yarn strength can not be provided for the yarn when the yarn consists of short fibers.

Accordingly, the present invention has been made to eliminate the disadvantages of abovementioned various spinning methods.

SUMMARY OF THE INVENTION

An object of the present invention is to provide a method for producing spun yarns capable of producing an improved spun yarn having a high yarn strength and smooth external appearance of less fluff.

The present invention provides a pneumatic spinning method of producing a spun yarn by making a first fluid swirling nozzle and a second fluid swirling nozzle act on a staple fiber bundle drafted in a predetermined thickness, wherein fibers detached from the false-twisted staple fiber bundle between the front roller and the first fluid swirling nozzle are made to wind positively round the false-twisted fiber bundle in the false twisting zone of the second fluid swirling nozzle.

The present invention also provides an apparatus for producing the spun yarns as mentioned above.

BRIEF DESCRIPTION OF THE DRAWINGS

FIGS. 6*a–f* are a representation for facilitating the explanation of the spun yarn forming principle of the spinning device of FIG. 5;

DETAILED DESCRIPTION OF THE INVENTION

The present invention will be described hereinafter with reference to a device for carrying out the present invention.

Figure 1:
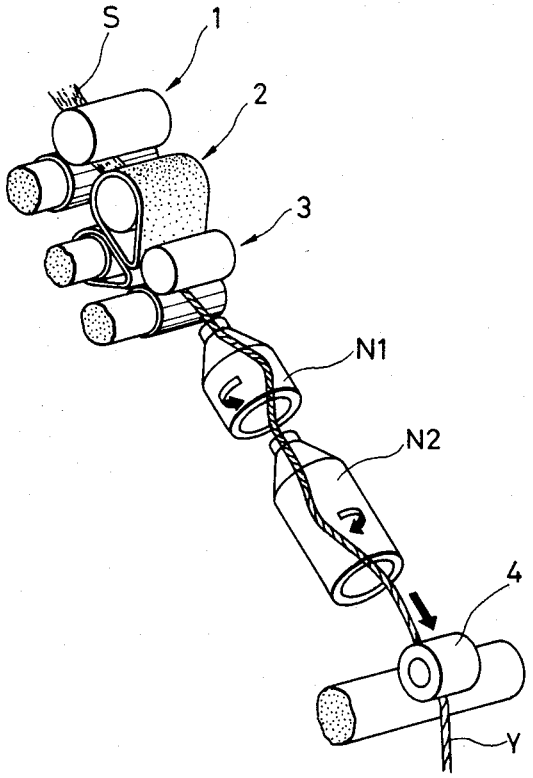
FIG. 1 is a perspective view of an embodiment of a spinning device for carrying out the present invention.
Figure 2:
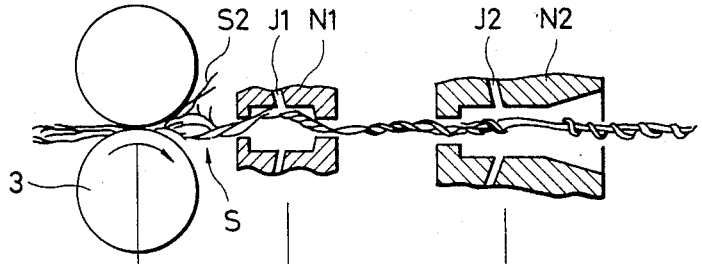
FIGS. 2 and 3 are representations for facilitating the spinning principle of the spinning device of FIG. 1.
Figure 3:
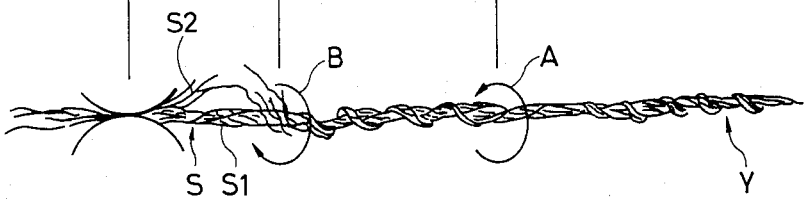

Referring to FIG. 1, after drafting a staple fiber silver S to a predetermined thickness by means of a drafting unit consisting of a back roller assembly 1, a middle roller assembly 2 and a front roller assembly 3, the staple fiber bundle is introduced through a first fluid swirling nozzle N1 (referred to as "first nozzle" hereinafter) and a second fluid swirling nozzle N2 (referred to as "second nozzle" hereinafter) to be converted into a spun yarn Y and the spun yarn Y is drawn out by a delivery roller assembly 4 and is wound up by a winding unit (not shown). Fluid jets J1 and J2 are drilled in those nozzles N1 and N2 so as to produce swirling fluid flows swirling in mutually opposite directions A and B, respectively, as shown in FIGS. 2 and 3. Any gas is applicable for the fluid material, however, compressed air will be sufficiently servicable, since compressed air is readily available.

Figure 4:
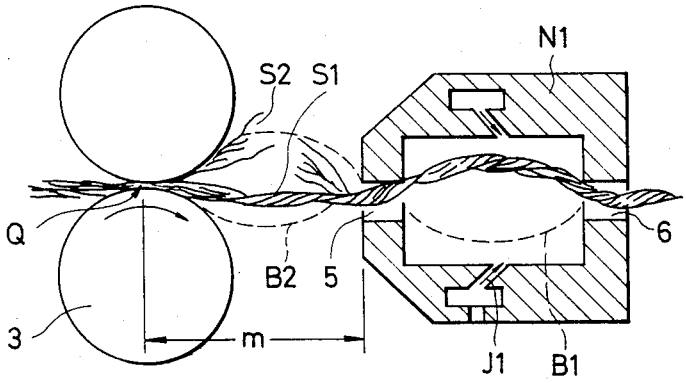
FIG. 4 is an enlarged partial sectional view illustrating the behavior of a yarn in the spinning device of FIG. 1.

In this device, a drafted sliver S delivered from the front roller assembly 3 is broken and detached by an act of ballooning formed by means of the first nozzle N1 operating at an air pressure lower than that of the second nozzle N2 as shown in FIGS. 2, 3 and 4. Either the major part or the minor part of the drafted sliver S may be broken and detached. Only the unseparated fibers S1 are twisted by the second nozzle N2 and part of or most part of the detached fibers S2 are forced to wind round the unseparated and false-twisted fibers S1 in a direction opposite to the direction of the false twist (S-twist in the drawings). At this time, the respective rear ends of most of the broken and detached fibers are gripped and restrained at the nip point of the front roller assembly 3.

Further detailed description of the behavior of the sliver will be provided hereunder with reference to FIG. 4. A part or major part of a sliver delivered through the nip point Q of the front roller assembly 3 is vibrated violently by a secondary balloon B2 produced between the inlet 5 of the first nozzle N1 and the nip point Q of the front roller assembly 3 as shown in FIG. 4 by a stable balloon B1 formed by the high speed revolution of the yarn within the chamber of the first nozzle N1. At this time, the yarn is revolved in a direction to untwist the false-twisted (S-twist) sliver. The yarn revolving force produced by the first nozzle N1 is set to be less than the yarn revolving force produced by the second nozzle N2. That is, air pressures P1 and P2 applied to the first nozzle N1 and the second nozzle N2, respectively, are preset so as to satisfy an unequality: $P1<P2$.

The detached fibers S2, then, are guided into the first nozzle N1 by the suction force of the first nozzle N1, while those detached fibers S2 are caused to wind round the false-twisted fiber bundle S1 again by an action of secondary ballooning yarn, in the direction of the revolution of the balloon, namely, in a direction opposite to the S-twist of the fiber bundle S1, before those detached fibers reach the inlet of the first nozzle N1. Naturally, those detached fibers are caused to wind round the unseparated fibers in the same direction as mentioned above, namely, in the direction of Z-twist by an air current swirling at a high speed within the chamber of the first nozzle N1, after entering the first nozzle N1.

The sliver thus passing through the first nozzle N1 is transferred to the second nozzle N2 in a dual structure consisting of S-twisted fibers and a part or the major part of the component fibers winding in a Z-twist direction round the S-twisted fibers. Accordingly, after passing the second nozzle N2, the sliver is subjected to untwisting action, so that the Z-twisted fibers are caused to wind further in the Z-twist direction, to turn and untwist the S-twisted fibers, to bind the S-twisted fibers firmly and to insert Z-twists in the untwisted fibers. The spun yarn Y thus produced has a yarn structure of a Z-twisted two ply yarn. Furthermore, orifices 5 and 6 are formed at the inlet and the outlet, respectively, of the first nozzle N1 which causes the sliver delivered from the front roller assembly to form a balloon and breaks and detaches a part or the major part of the drafted sliver positively, as shown in FIG. 4. The orifices, particularly the orifice 5 formed at the inlet of the first nozzle N1 serves to stabilize the secondary balloon formed between the front roller assembly 3 and the first nozzle N1.

Figure 5:
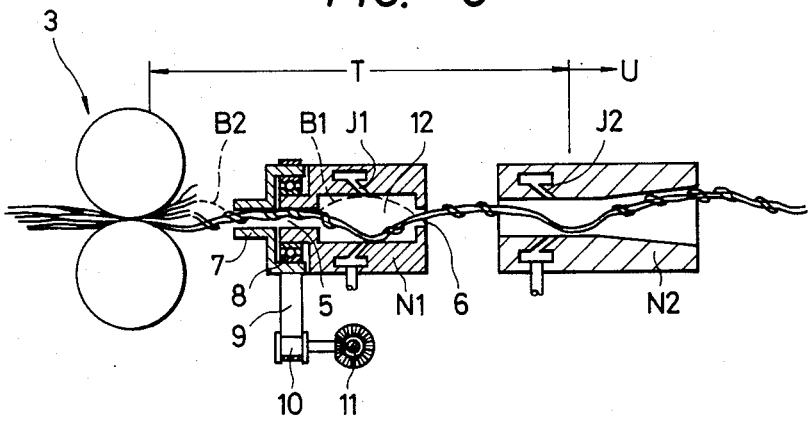
FIG. 5 is a sectional view of another embodiment of a spinning device for carrying out the present invention.
Figure 7:
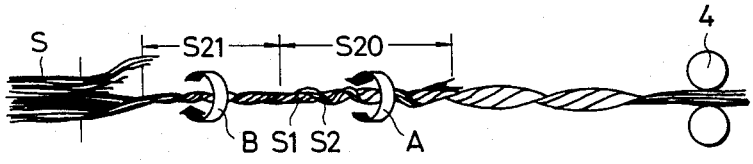
FIG. 7 is a typical representation illustrating the manner of detached fibers winding round the unseparated fibers.

FIG. 5 shows another embodiment of a device for carrying out the present invention.

Referring to FIG. 5, a first nozzle N1 is disposed within the twisting zone T between the nip point Q of a front roller assembly 3 and a second nozzle N2 and is provided with orifices 5 and 6 at the inlet and the outlet, respectively, thereof. The respective diameters of the orifices 5 and 6 are smaller than the inside diameter of the chamber of the first nozzle N1. A rotary tube 7 is disposed between the front roller assembly 3 and the first nozzle N1. The rotary tube 7 is attached to the circumference of the inlet end of the nozzle N1 through a bearing 8 for rotation in the same direction as the direction of rotation of the yarn caused by the first nozzle N1 is driven for rotation by a driving shaft 11 through a belt 9 and a pulley 10. The axis of rotation of the rotary tube 7 is aligned with the center axis of the cavity 12 of the first nozzle N1 and hence the rotary tube 7 does not obstruct the propagation of false twists produced by the second nozzle N2 and also does not impede the formation of a secondary balloon between the front roller assembly 3 and the first nozzle N1 by the agency of a primary balloon produced by the first nozzle N1. The revolving speed of the rotary tube 7 is preset at an appropriate value by taking into consideration the quality of the yarn to be spun or the yarn speed. In any case, it is necessary that the rotary tube 7 is not stationary and the revolving rate thereof may be very low so far as the rotary tube rotates. The rotary tube 7 serves to make fibers S2 detached from false-twisted fibers S1 wind positively round the twisted fibers forming the central part of the yarn.

FIG. 6 illustrates the yarn forming steps in the above-mentioned spinning device.

Referring to FIG. 6, a drafted bundle of staple fibers S is delivered from the nip point Q of the front roller assembly 3 to the first nozzle N1 and then, to the second nozzle N2. The arrow B indicates the revolving direction of the balloon of a yarn formed by a swirling current flowing within the first nozzle N1, while the arrow A indicates the revolving direction of a balloon formed within the second nozzle N2. The yarn revolving direction of the first nozzle N1 is opposite to that of the second nozzle N2. In FIG. 6, S-twists are produced in the twisting zone T of the second nozzle N2. A drawing roller assembly is indicated at 4.

FIG. 6-*a* shows a state in which the yarn is not running, while false twists are produced only by the second nozzle. Part of the yarn extending within the twisting zone T is S-twisted, while other part of the yarn extending within the untwisting zone U is Z-twisted.

FIG. 6-*b* shows a state in which the yarn is running and the second nozzle N2 is in false-twisting operation. In this state, the S-twists inserted in the yarn in the twisting zone T are untwisted gradually after the yarn has passed through the second nozzle N2. Fundamentary, the yarn is expected to be untwisted to zero-twist in the untwisting zone, however, some of the S-twists inserted in the yarn in the twisting zone still remains in the yarn in the untwisting zone as the yarn is false-twisted by an air current on the embodiment of an air false twisting device as described hereinbefore.

FIG. 6-*c* shows a state similar to that of FIG. 6-*b*, except that the first nozzle N1 is disposed between the front roller assembly 3 and the second nozzle N2. In this state, a part S2 of the fiber bundle S delivered from the front roller assembly 3 is detached from the fiber bundle S being false-twisted by the agency of the first nozzle N1 and the fibers of the detached part S2 are in the state of open end.

FIG. 6-*d* shows a state in which the detached fibers S2 detached from the fiber bundle S in the state of FIG. 6-*c* are in the twisting zone. In this state, the detached fibers S2 are caused to wind round the false-twisted fibers S1 in a direction (Z-twist) opposite to the false-twisting direction (S-twist).

FIG. 6-*e* shows the condition of the fibers S2, which were caused to wind round the false-twisted fibers in the state of FIG. 6-*d*, in the untwisting zone U. The fibers winding in the direction of Z-twist, which is opposite to the false-twisting direction of S-twist, is twisted further in the direction of Z-twist by the untwisting operation in the untwisting zone U.

FIG. 6-*f* shows a state in which real Z-twists are inserted in the yarn Y which passed through the drawing roller assembly 4 and the spun yarn thus produced is moved to the winding unit.

In this embodiment, a yarn is produced through the steps of FIGS. 6-*c* to 6-*f* by passing fibers through the steps in the order of the steps of FIG. 6-*c*→6-*d*→6-*e*→6-*f*.

In the yarn forming step of FIG. 6-*d*, the detached fibers S2 detached from false-twisting operation are caused to wind round the twisted fibers S1 by the agency of the balloon of the yarn. In this embodiment, since the rotary tube 7 is disposed between the front roller assembly 3 and the first nozzle N1 and is rotated positively in the same direction as the direction of revolution of the balloon caused by the first nozzle N1, the fibers S2 detached from the fiber bundle S can be made to wind positively round the twisted fibers S1. Accordingly, the spun yarn thus formed has a high Z-twist, a large strength and smooth external appearance having less fluff.

In FIGS. 6-*d* and 6-*e*, the winding pitches of the detached fibers S2 are indicated at l1 and l2 respectively and $l1 > l2$.

A yarn of insufficient strength is produced when the amount of the detached fibers is excessively small, whereas a yarn is liable to break when the amount of the detached fibers is excessively large. Accordingly, it is necessary that amount of the detached fibers is controlled at an appropriate amount. In this embodiment, the amount of the detached fibers can be controlled through the regulation of the revolving rate of the balloons by controlling the respective air pressure applied to the first nozzle and the second nozzle. For example, the respective air pressures applied to the first nozzle N1 and the second nozzle N2 are preset so that the revolving number n1 of the balloon formed by the agency of the first nozzle N1 is greater than the revolving number n2 of the balloon formed by the agency of the second nozzle N2.

Figure 8:
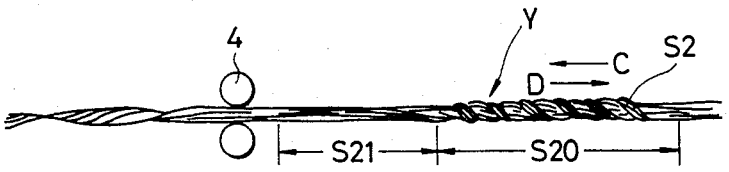
FIG. 8 is a typical representation illustrating the yarn structure of a spun yarn produced through the method of the present invention.

A part of the fiber bundle delivered from the front roller assembly 3 is detached from false twisting operation between the front roller assembly 3 and the first nozzle N1 as described hereinbefore, then the front part S20 of the detached fibers is caused to wind round the false-twisted fibers S1 in a opposite direction relative to the direction of false twisting, whereas the back part S21 of the detached fibers is intertwined with the false-twisted fibers. Accordingly, passing through the second nozzle N2, the front part of the detached fibers is twisted further in the winding direction, namely, in the Z-twist direction in this embodiment, through untwisting operation, while the back part of the detached fibers remains within the undetached fibers S1 in the state of Zero twist. Consequently, the yarn assumes a yarn structure as shown in FIG. 8.

A spun yarn Y thus produced has directional characteristics. That is, when the yarn is rubbed in the direction of the arrow C, the winding fibers S2 are moved out of the position to form neps, whereby mutual slip is caused between the component fibers and hence the yarn is liable to break. On the contrary, the yarn exhibits a strength several times as great as the strength of a ring-spun yarn and less neps are formed over the surface of the yarn, when the yarn is rubbed in the direction of the arrow D.

Spinning experiments and their results will be described hereinafter. The device of FIGS. 1 and 2 was employed in the spinning experiments.

EXPERIMENT 1

Conditions:

1. Sliver: 65% polyester×35% combed cotton, 330 grains/6 yd.
2. Mean fiber length: 27 mm.
3. Yarn count: Ne30
4. Draft ratio: 198
5. Spinning speed: 150 m/min.
6. Air pressure: Nozzle N1: 3.0 kg/cm$^2$, Nozzle N2: 4.0 kg/cm$^2$.
7. Distance between the nip point of the front roller assembly and the inlet of the nozzle N1: 9 mm.

Results:

1. Yarn strength: 355 g (CV=8%).
2. U%: 10.8%.
3. Thin part: 24/1000 m, Thick part: 16/1000 m
4. Neps: 56/1000 m A spun yarn having a high strength and quality comparing favorably with a ring-spun yarn was obtained.

EXPERIMENT 2

Condition:

1. Sliver: 180 grains/6 yd.
2. Mean fiber length: 27 mm.
3. Spinning speed: 135 m/min.
4. Draft ratio: 200.
5. Yarn count: Ne45
6. Air pressure: P1: 2.4 kg/cm$^2$, P2: 2.5 kg/cm$^2$.
7. Distance between the nip point of the front roller assembly and the inlet of the nozzle N1: 6 mm.

Results:

1. Yarn strength: 210 (CV=10%)
2. U%: 12.5%.

The strength of the yarn compares favorably with that of a ring-spun yarn.

EXPERIMENT 3

Condition:

1. Worsted roving: Double roving, 0.8 g/m.
2. Mean fiber length: 76 mm.
3. Yarn count: Nm40.
4. Draft ratio: 30.
5. Spinning speed: 130 m/min.
6. Air pressure: P1: 4.0 kg/cm$^2$, P2: 5.0 kg/cm$^2$.
7. Distance between the nip of the front roller assembly and the inlet of the nozzle N1: 15 mm.

Result:

1. Yarn strength: 150 g (CV=8%).

As been described hereinbefore, according to the present invention, fibers detached from a sliver between a front roller assembly and a first fluid swirling nozzle are caused to wind positively round twisted fibers during spinning operation and hence the method of the present invention is capable of producing a spun yarn having an increased strength and smooth external appearance with less fluff.

What is claimed is:

1. A spun yarn manufacturing method for spinning a spun yarn, comprising the steps of:

a. running a drafted staple fiber bundle from a nip point of a front roller of a spinning maching to and through a first fluid swirling nozzle;

b. twisting the drafted staple fiber bundle by the action of a fluid within the first fluid swirling nozzle;

c. running the drafted staple fiber bundle from the first fluid swirling nozzle to and through a second fluid swirling nozzle capable of swirling a fluid in a direction opposite to the direction of swirling of the fluid in said first fluid swirling nozzle on the drafted staple fiber bundler, the swirling in said first and said second fluid swirling nozzles being so controlled as to produce a greater fiber bundle revolving force within said second fluid swirling nozzle than within said first fluid swirling nozzle;

d. creating, by the greater fiber bundle revolving force of second said fluid swirling nozzle, a false-twist of the drafted staple fiber bundle, which false-twist is enabled to be communicated along the drafted staple fiber bundle through said first fluid swirling nozzle to form a twisting zone between the nip point of said front roller and said second fluid swirling nozzle;

e. concurrently forming, by the action of the first fluid swirling nozzle, a balloon in the drafted staple fiber bundle between the nip point of said front roller and said first fluid swirling nozzle, said balloon causing fibers to be detached from the false-twisted staple fiber bundle between the front roller and said first fluid swirling nozzle;

f. winding, by action of the balloon, the detached fibers positively around the false-twisted staple fiber bundle within the twisting zone between the nip point of said front roller and said second fluid swirling nozzle; and g. taking a spun yard out of the second fluid swirling nozzle such that the winding of the previously detached fibers around the staple fiber bundle is increased by the natural unwinding of the false-twist of the drafted staple fiber bundle, thereby forming a spun yarn having increased strength, a smooth external appearance, and a reduced fluff content.

2. A spun yarn manufacturing method for spinning a spun yarn, comprising the steps of:

a. running a drafted staple fiber bundle from a nip point of a front roller of a spinning machine to and through a first fluid swirling nozzle;

b. twisting the drafted staple fiber bundle by the action of a fluid within the first fluid swirling nozzle, thereby forming a balloon in the drafted staple fiber bundle between the nip point of the front roller and the first fluid swirling nozzle;

c. running the drafted staple fiber bundle from the first fluid swirling nozzle to and through a second fluid swirling nozzle capable of swirling a fluid in a direction opposite to the direction of swirling of the fluid in the first fluid swirling nozzle, the swirling in said first and said second fluid swirling nozzles being so controlled as to produce a greater fiber bundle revolving force within said second fluid swirling nozzle than within said first fluid swirling nozzle;

d. creating, by the greater fiber bundle revolving force of said second fluid swirling nozzle, a false-twist condition in the drafted staple fiber bundle, which false-twist condition is enabled to be communicated along the drafted staple fiber bundle through said first fluid swirling nozzle to form a twisting zone between the nip point of the front roller and the second fluid swirling nozzle;

e. detaching, by the combined revolving actions of the false-twist and balloon produced by the second fluid swirling nozzle and the first fluid swirling nozzle, respectively, fibers from the drafted staple fiber bundle in the balloon between the front roller and the first fluid swirling nozzle;

f. winding said detached fibers positively around the false-twisted fiber bundle forming the central part of the yarn, the winding being performed by means of a rotary tube which is disposed between the front roller and the first fluid swirling nozzle and which is rotated in the same direction as the direction of rotation of the fiber bundle caused by the first fluid swirling nozzle; and g. taking a spun yarn out of the second fluid swirling nozzle while concurrently allowing the false-twisted of the drafted fiber bundle to unwind, thereby increasing the winding of the previously detached fibers around the staple fiber bundle to produce a spun yarn having increased strength, a smooth external appearance, and a reduced fluff content.

3. An apparatus for producing spun yarns including a drafting unit for drafting a staple fiber sliver, a first fluid swirling nozzle, a second fluid swirling nozzle capable of swirling a fluid in a direction opposite to the direction of swirling of a fluid in said first fluid swirling nozzle, a delivery roller assembly and a winding unit, characterized in that a rotary tube is attached to the circumference of the inlet end of said first fluid swirling nozzle, the axis of rotation of said rotary tube being aligned with the center axis of a cavity of the first fluid swirling nozzle.

4. An apparatus for producing spun yarns as claimed in claim 3, wherein said first fluid swirling nozzle is provided with orifices at the inlet side and the outlet side thereof and the respective diameters of the orifices and the rotary tube attached to the orifice at the inlet side are smaller than the inside diameter of the cavity of the first fluid swirling nozzle.

5. A spun yarn manufacturing method as claimed in claim 1, further comprising a step for establishing a distance between the nip point of the front roller and said first fluid swirling nozzle to be less than a mean fiber length of fibers within the drafted staple fiber bundle entering through said front roller, said step being performed prior to the initiation of running a drafted staple fiber bundle through a spinning machine performing the manufacturing method.

* * * * *